United States Patent [19]

von der Eltz et al.

[11] Patent Number: 4,911,735

[45] Date of Patent: Mar. 27, 1990

[54] PROCESS FOR DYEING WOOL

[75] Inventors: Hans-Ulrich von der Eltz, Frankfurt am Main; Karl-Heinz Röstermundt, Eschborn; Klaus Türschmann, Hofheim am Taunus, all of Fed. Rep. of Germany

[73] Assignee: Hoechst Aktiengesellschaft, Frankfurt, Fed. Rep. of Germany

[21] Appl. No.: 942,520

[22] Filed: Dec. 16, 1986

[30] Foreign Application Priority Data

Dec. 18, 1985 [DE] Fed. Rep. of Germany ..... 3544796

[51] Int. Cl.[4] ..... C09B 67/00

[52] U.S. Cl. ..... 8/549; 8/638; 8/917; 8/DIG. 2

[58] Field of Search ..... 8/638, 549, 917, DIG. 2, 8/128.1, 128.3

[56] References Cited

U.S. PATENT DOCUMENTS

| | | | |
|---|---|---|---|
| 0,702 | 4/1838 | Fossard | 8/638 |
| 4,350,494 | 9/1982 | Scheidegger et al. | 8/636 |
| 4,568,350 | 2/1986 | Roherer | 8/648 |
| 4,622,045 | 11/1986 | Frauenknecht et al. | 8/604 |

FOREIGN PATENT DOCUMENTS

| | | |
|---|---|---|
| 0193053 | 9/1986 | European Pat. Off. . |
| 2700153 | 7/1977 | Fed. Rep. of Germany . |
| 960269 | 6/1964 | United Kingdom . |
| 1458632 | 12/1976 | United Kingdom . |
| 2006277 | 5/1979 | United Kingdom . |
| 2023187 | 12/1979 | United Kingdom . |

OTHER PUBLICATIONS

Kollodzeiski, N. ("Remazolan-Farbstoffe, eine neue Farbstoffgruppe fuer die Wolle"), Meilland Textilberichte 45, 51-54 (1964).

German Industrial Standard (DIN) No. 54 020 (12/69) ("Determination of Color Fastness of Dyeings and Prints to Perspiration").

German Industrial Standard (DIN) No. 54 013 (1/71) ("Determination of Wash-Fastness for Dyeings and Prints: Mech. Wash. 50° C.".

*Color Index*, 3rd Ed., Soc. of Dyes and Colorists, 1972, "Acid Dyes", pp. 1001-1002.

Shade Bulletin S 8126, "REMAZOLAN-Farbstoffe auf Wolle" (REMAZOLAN Dyestuffs on Wool), trade lit. of Hoechst AG, 1963, pp. 3-13.

*Primary Examiner*—Prince E. Willis

*Assistant Examiner*—John F. McNally

[57] ABSTRACT

Trichromatic dyeings with acid dyes which exhaust from strongly acidic liquors have weaknesses with respect to wet fastness, which are due to insufficiently fast components (blue, red). It has been found, according to the invention, that by replacing the insufficiently fast acid dyes by reactive dyes of the vinylsulfonyl type and retaining the method of dyeing under strongly acidic conditions the wet fastness level of the exhaust dyeings can be improved while the levelness obtained remains as good.

9 Claims, No Drawings

PROCESS FOR DYEING WOOL

The present invention relates to a process for the level dyeing of wool or of the wool portion of fiber blends by the exhaust dyeing technique with aqueous liquors of dyes which exhaust under strongly acidic conditions.

The dyeing of weel from an aqueous medium with acid dyes at pH values of 2 to 3 is sufficiently well known. This pH value is customarily established by adding strong acids to the dyebath, for example sulfuric or formic acid. The dyes used for this purpose in the field generally produce on the dyed textile material a fastness level which, although adequate for wool piece goods, is not sufficient for slubbing, yarn or loose fiber. In contrast, the leveling behavior of the dyes thus applied is good and normally does not present any difficulties.

Yet trichromatic dyeings on wool with the product ranges of such acid dyes which dye under strongly acidic conditions frequently have, in particular in the red and blue region of the color spectrum, weaknesses with respect to the wet fastness properties, which force the dyer to resort to faster components of the desired hue, although this in turn brings with it complications in regard of level dyeing.

The dyeing of wool with reactive dyes has in the meantime likewise become common knowledge among those skilled in the art. This class of dye is dyed on wool with various safety precautions at pH values within the range 5.5 to 6.5. The restrictive precautions mentioned, such as, for example, increasing the temperature in stages, using a dyeing procedure which involves very long heating-up times for the liquor and the like, primarily serve to obtain level dyeings, since it is that aspect which is generally the problem in the dyeing of wool with reactive dyes. On the other hand, employing these weakly acidic conditions produces dyeings having a very high fastness level.

It is true that shade card S 8126 "® Remazolan dyes on wool" from Hoechst AG from 1963 describes the exhaust dyeing of wool articles with reactive dyes of the vinyl-sulfonyl type even from strongly acidic liquors, but the dyeing method described there did not go against the prejudice that level dyeings can only be obtained by using extended heating-up times. Yet the fastness properties of such dyeings produced in a strongly acidic medium are somewhat below those of dyeings produced with the abovementioned, weakly acidic pH, technique.

It is thus an object of the present invention to develop a dyeing process for wool which makes it possible for the dyer, while retaining excellent levelness, to obtain dyeings under strongly acidic conditions but with a raised fastness level, and which makes it possible to eliminate the fastness weaknesses in the product ranges of acid dyes which exhaust under strongly acidic conditions without having to change the dyeing process.

This object is achieved according to the invention by bringing exhaust liquors which contain combinations of acid dyes which exhaust under strongly acidic conditions and reactive dyes into contact with the material to be dyed at pH values between 2 and 3 while heating.

However, the principle underlying the novel dyeing process must appear completely absurd to a skilled worker, since on the one hand he knows of the good leveling behavior of the acid dyes which exhaust under strongly acidic conditions—which is after all why they are often used for wool piece goods,—but on the other he knows of the leveling problems in the dyeing of wool with reactive dyes.

But according to the invention it has now been found that reactive dyes, in particular of the type of the vinylsulfonyl compounds, permit level dyeings on wool at pH values of 2 to 3 with only insignificant decreases in the known, otherwise high fastness level of dyeings with reactive dyes. These unforeseeable findings led to formulating trichromatic recipes by combining dyes from the two very different classes of dyes, i.e. reactive dyes and acid dyes which exhaust under strongly acidic conditions, with each other and replacing acid dyes having inadequate fastness properties by reactive dyes of the same or similar shade to obtain better wet fastness properties for the intended wool dyeings without the danger of an unlevel appearance having to be accepted.

To dye wool fibers or the wool portion of fiber blends by the present process, suitable acid dyes are the chemical compounds listed in the Colour Index, 3rd edition 1971 and supplement 1975, under the heading of "C.I. Acid Dyes", with the restriction that according to the invention only those representatives of this category of dye are regarded as suitable for the application of which dyeing method 3 cited under the heading "The Dyeing of Wool" in volume 1, page 1001, is recommended. This applies to those dyes which are dyed in the presence of sulfuric acid.

Suitable reactive dyes for carrying out the invention are the organic dyes referred to generically in the Colour Index, 3rd edition 1971 and supplement 1975, as "C.I. Reactive Dyes", which are capable of entering a covalent bond with OH- and/or NH-containing fibers. These are predominantly dyes which contain at least one group capable of reacton with hydroxyl or amino groups in the fiber material of polyamide structure, a precursor thereof or a substituent capable of reaction with said constituents of the fiber molecule.

It is preferable to use for the present process dyes of the vinylsulfonyl type with which the fiber reacts by an addition mechanism via the vinylsulfonyl form of the dye. Such dyes, in addition to containing the vinyl-sulfonyl radical itself as the group capable of reaction with the wool textile material, can have as precursors of this characteristic grouping the $\beta$-sulfatoethylsulfonyl group, the $\beta$-chloroethylsulfonyl group or the $\beta$-dialkylaminoethylsulfonyl group, which during dyeing react with the fiber via the vinylsulfonyl form intermediate.

It is also possible to use in the claimed process the conversion products of such known sulfonyl reactive dyes with, for example, methyltaurine, in which the reactive group is temporarily present in masked form.

Reactive dyes having other reactive systems can be used for the new process only after extremely rigorous selection, since only individual dyes from such product ranges can be dyed level onto wool under the strongly acidic application conditions.

It is all the more surprising that dyes which, in addition to a reactive radical of the vinylsulfonyl type or, as a precursor thereof, one of the reactive groupings described above, have one or more groupings which react with wool by the substitution mechanism, for example a monochlorotriazinyl or monofluorotriazinyl group, produce by the process of the invention on wool articles dyeings of excellent levelness and very high fastness properties.

Suitable basic structures of the chromophoric system of these organic dyes with reactive groups are in particular those from the series of the azo, anthraquinone and phthalocyanine compounds, it being possible for the azo and phthalocyanine dyes to be either metal-free or metal-containing.

Reactive dyes of the previously defined type frequently have more than one sulfonic acid group (in addition to that in the reactive grouping of the dye) in the molecule; these sulfonic acid groups can be distributed over the chromophore in any desired way but are preferably bonded to the aromatic radicals thereof.

On the basis of the new process it is thus possible for the dyer, by combining customary acid dyes with reactive dyes, to utilize his dye stores even better without being forced by shortcomings in trichromatic dyeing to give up a long-established dyeing method or to suffer lower fastness properties.

The acid used for setting the pH value of 2 to 3 is expediently sulfuric acid in the exhaust dyeing method of the invention. This requires amounts of 3 to 5% of 96% strength $H_2SO_4$, based on the weight of wool.

The exhaust dyeing process according to the invention is chiefly used for ordinary wool, i.e. wool which has not been pretreated with an antifelting finish, or fiber blends of such composition. In general the process is used for dyeing piece goods, where satisfactory levelness of the dyeings is particularly critical. However, the higher fastness level of the obtainable dyeings makes it possible, in special cases, also to use this dyeing technique for other kinds of woolen textiles.

To carry out the new process, two variants are available:

In the first method, the exhaust liquor is made up at 50° C. with all ingredients, such as the two types of dye, assistants as well as the required acid. After a prerun time together with the material to be dyed of about 10 minutes, the bath is then raised to the dyeing temperature (95° to 110° C.) in the course of 30 to 50 minutes, and the material is then dyed under these temperature conditions for 60 to 90 minutes. Then, by running cold water into the dyeing vessel, the dyeing produced is cooled down, and subsequently rinsed clear and dried.

The aforementioned method has certain disadvantages compared with the variant below, so that the latter will generally be preferred. These disadvantages are primarily the longer dyeing time (2 to 2½ hours). In addition, carbonized wool must be especially neutralized before the dyeing step, which again requires more time and chemicals.

In the second process variant, the dyebath is made up at 50° C. with both types of dye and also assistants, but without the sulfuric acid required for dye fixation, the liquor is raised to the dyeing temperature (95° to 110° C.) as rapidly as the machine will allow, and the acid is then metered into the liquor, which is under fixing conditions for the dyes, over a prolonged period (20 to 40 minutes) in linear or progressive amounts, the metering time being subsumed in the total dyeing time of 60 to 90 minutes. The way in which metering is carried out is thus variable within very wide limits, so that the measures in this respect can be carried out not only discontinuously, in portions, but also in a continuous stream in accordance with a predetermined time schedule. Thereafter the dyed material is cooled down, rinsed and dried.

This second process variant results in a distinct shortening of the dyeing time (only 80 to 120 minutes in total). The fastness level of the dyeings and their appearance (levelness) are completely unaffected. It is to be noted in particular that the dyeing treatment according to this variant is also suitable for carbonized wool, which need not be neutralized before dyeing, so that the overall time saving is even higher in this specific case.

The exmaples which follow are not intended to restrict the claimed process in any way, in particular not in any respect to the dye combinations used, but merely serve to illustrate the procedure of the present invention. The percentages given in these worked examples are based on the weight of the articles to which they refer, and in the case of wool are expressed relative to the dry state of the material to be dyed. The reactive dyes mentioned are used in commercially available form and constitution.

Dyes which are conversion products of sulfonyl reactive dyes with N-methyltaurine are present after the prescribed dissolving step in a structure reproduced by the respective formula.

EXAMPLE 1 (PROCESS VARIANT 1)

50 kg of a wool fabric which has not been pretreated with an antifelting finish are dyed in a liquor ratio of 15:1 with an aqueous liquor which is prepared by introducing the following ingredients into water at 50° C.:

0.17% of the dye Acid Yellow 17 having the C.I. No. 18965 (I), 0.4% of a red reactive dye obtained by conversion from the corresponding dye of the vinylsulfonyl type with N-methyltaurine and having the formula II

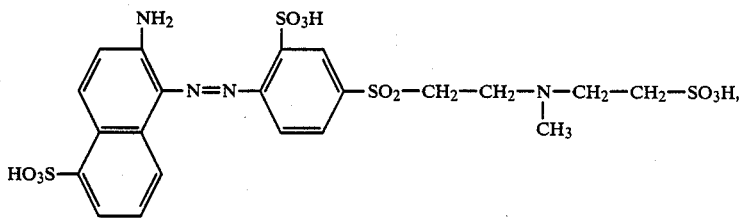

(II)

0.3% of a blue reactive dye obtained by conversion from the corresponding dye of the vinylsulfonyl type with N-methyltaurine and having the formula III

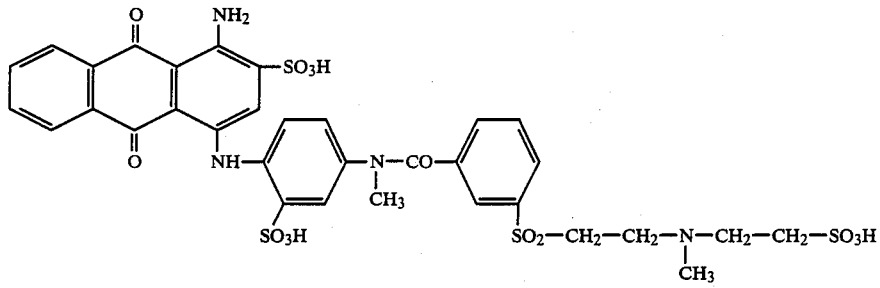

(III)

10% of sodium sulfate, 0.5% of an assistant mixture comprising the reaction product of 1 mol of stearylamine with 12 mols of ehtylene oxide, to which triisobutyl phosphate has been aded as an antifoam, and 4% of 96% strength sulfuric acid.

After the customary prerun of about 10 minutes of the liquor which has been charged with the material to be dyed the temperature of the bath is then raised to 98° C. in the course of 40 minutes, and the material is then dyed under these temperature conditions for 80 minutes. The dyed wool is then cooled down by running cold water into the bath and is then rinsed with further water until clear.

Drying leaves a very level and fast dyeing of the wool fabric in a sandy shade.

Comparison 1

The above example is repeated, except that in the recipe dye II (red reactive dye) is replaced by 0.17% of the dye Acid Red 42 with a C.I. No. 17070 and the amount of dye I is increased to 0.25%, affording a likewise level dyeing of similar hue which, however, as a consequence of the red acid dye bleeding is poorer in the wet fastness properties (DIN 54013 and DIN 54020) than the dyeing according to the invention by 1 to 1½ fastness points.

Comparison 2

The above example is repeated, except that in the recipe dye III (blue reactive dye) is replaced by 0.15% of the dye Acid Blue 40 having the C.I. No. 62125, affording a level dyeing of similar hue which, however, as a result of the blue acid dye bleeding is poorer in the wet fastness properties (DIN 54013 and DIN 54020) than the dyeing according to the invention by 1 to 1½ points.

EXAMPLE 2 (PROCESS VARIANT 2)

To dye by exhaustion 20 kg of a wool fabric which has previously been carbonized but not neutralized, using a liquor ratio of 20:1, an aqueous liquor is prepared at 50° C. with:

0.2% of the dye Acid Yellow 17 having the C.I. No. 18965, 0.3% of the dye Reactive Orange 16 having the C.I. No. 17757, 0.2% of the dye Acid Blue 41 having the C.I. No. 62130, 10% of sodium sulfate and 0.5% of the assistant mixture of Example 1.

After the fabric has been introduced into this dyebath the bath temperature is raised as rapidly as possible—modern apparatuses make possible a heating-up time of 10 minutes—to the boil and, immediately on reaching the boiling temperature, the liquor which is under fixing conditions has metered into it by means of an ADC 100 dispenser from ADCON AB, Boras/Sweden 4% of 96% strength sulfuric acid, diluted by means of water, continuously in the course of a period of 30 minutes in amounts per unit time which progressively increase by 40%. During the metering process and for a further 30 minutes thereafter, the exhaust bath is maintained at the boil. The liquor plus the fabric is then cooled down, and the dyed wool is rinsed with water and finished in conventional manner.

The result obtained on the wool is a very level sandy dyeing having good fastness properties.

EXAMPLE 3

20 kg of an ordinary wool crepe fabric are to be exhaust-dyed on a beam dyeing apparatus with a liquor ratio of 10:1:

To this end

1% of the dye Acid Brown 248 having the C.I. No. 10402,

1% of the reactive dye of the formula

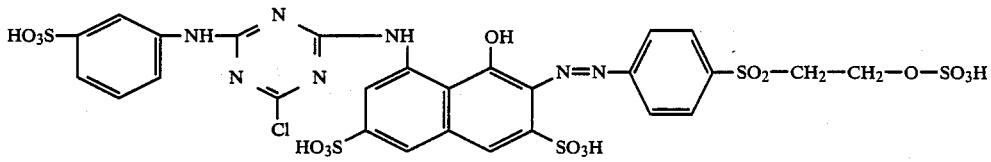

0.8% of the dye Acid Blue 41 having the C.I. No. 62130,

10% of sodium sulfate and 0.5% of the assistant mixture of Example 1 are dissolved in an aqueous bath at 50° C. This liquor is then heated up together with the entered fabric to 100° C. in the course of 10 minutes, and immediately that temperature is reached 5% of 96% strength sulfuric acid are metered in. The metering process is carried out manually by pouring the acid into 20 liters of cold water, and every 5 minutes adding linear 4 liter portions of this total volume of dilute acid (except for the last addition, where all of the remainder is added) to the dyebath. After all the acid has been added, the wool is dyed at 100° C. for a further 40 minutes and is then cooled down, rinsed with water and finished.

The result obtained is a level, fast brown dyeing.

We claim:

1. A process for the level dyeing of wool or of the wool portion of a fiber blend by the exhaust dyeing technique, with a trichromatic dyeing recipe, said process comprising:

bringing the wool or fiber blend into contact with an aqueous exhaust liquor containing the trichromatic dyeing recipe and dyeing the wool or fiber blend while maintaining a dyeing pH between 2 and 3 and a temperature in the range of 95° to 110° C., said trichromatic dyeing recipe consisting essentially of at least three dyestuffs, at least one, but not all, of the dyestuffs being an acid dye which exhausts under strongly acid conditions, and at least one, but not all, of the dyestuffs being a reactive dye containing in the molecule at least one group which, under fixing conditions, reacts with the fiber via the vinyl sulfonyl radical by nucleophilic addition;

cooling the resulting dyed wool or fiber blend, and recovering dyed wool or fiber blend exhibiting level trichromatic effects.

2. The process as claimed in claim 1, wherein the reactive dye is introduced in the form of a dye having a precursor of the vinyl-sulfonyl radical, said precursor being the β-sulfatoethylsulfonyl group, the β-chloroethylsulfonyl group or the β-dialkylaminoethylsulfonyl group.

3. The process as claimed in claim 1, wherein at least one of said reactive dye has at least one monochlorotriazinyl or monofluorotriazinyl group in addition to the group or groups which react with the fiber via the vinyl sulfonyl radical.

4. The process as claimed in claim 1, wherein the trichromatic recipe includes an assistant mixture consisting essentially of a reaction product of stearyl amine and ethylene oxide.

5. the process as claimed in claim 1, wherein the exhaust liquor which contains such dye combinations, but no acid or acid-donating agent require for fixing the dyes, is heated up together with the material to by dyed to the dyeing temperature within the said range from 95° to 110° C. as rapidly as possible and in one step, then, on reaching said dyeing temperature and while maintaining appropriate isothermal conditions for dye fixation, the hot dyebath has added to it sulfuric acid in portions over a prolonged period, and the wool is dyed in the indicated strongly acid pH range.

6. The process as claimed in claim 5, wherein the exhaust liquor, substantially free of any acid or acid-donating agent for fixing of the dyes, is heated up in a single heating step together with the wool or fiber blend to a said temperature in the range of 95° to 110° C., and the acid needed to lower the pH to a value in the range of 2 to 3 is added subsequent to said single heating step, while maintaining isothermal conditions for dye fixation, whereby the dyeing with the trichromatic recipe can proceed at said pH and under said temperature conditions.

7. The process as claimed in claim 1, wherein the temperature in the range of 95° to 110° C. is maintained for at least about 60 minutes but the total dyeing time is not longer than about 2½ hours.

8. The process as claimed in claim 1, wherein wool which has not been pretreated with an antifelting finish is dyed.

9. The process as claimed in claim 1, wherein carbonized wool which has not been subjected to prior neutralization is dyed.

* * * * *